US006138314A

United States Patent [19]

Schiff et al.

[11] Patent Number: 6,138,314

[45] **Date of Patent: *Oct. 31, 2000**

[54] TOOTHBRUSH WITH IMPROVED CLEANING AND ABRASION EFFICIENCY

[75] Inventors: Thomas Schiff, Tiburon, Calif.; Ira D. Hill, Locust, N.J.

[73] Assignee: WhiteHill Oral Technologies, Inc., Locust, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,679

[22] Filed: Jul. 24, 1997

Related U.S. Application Data

[60] Provisional application No. 60/022,601, Jul. 25, 1996.

[51] Int. Cl.[7] ..... A46B 9/04

[52] U.S. Cl. ..... 15/167.1; 15/207.2; 428/397; 428/401

[58] Field of Search ..... 15/167.1, 207.2; 428/397, 401

[56] References Cited

U.S. PATENT DOCUMENTS

| | | | |
|---|---|---|---|
| 2,071,250 | 2/1937 | Carothers | 526/71 |
| 2,071,251 | 2/1937 | Carothers | 524/31 |
| 2,088,839 | 8/1937 | Coney et al. | 15/188 |
| 2,130,948 | 9/1938 | Carothers | 15/159.1 |
| 2,226,529 | 12/1940 | Austin | 606/231 |
| 2,312,828 | 3/1943 | Adamsson | 401/268 |
| 2,317,485 | 4/1943 | Rider | 15/167.1 |
| 2,599,191 | 6/1952 | Meunier | 15/167.1 |
| 2,637,893 | 5/1953 | Shaw | 15/207.2 X |
| 2,697,009 | 12/1954 | Ingraito | 300/2 |
| 2,845,649 | 8/1958 | Hutson | 15/167.1 |
| 2,876,477 | 3/1959 | Stewart | 15/167.1 |
| 2,911,761 | 11/1959 | Anderson | 451/194 |
| 2,913,442 | 11/1959 | Matlack | 526/63 |
| 2,916,475 | 12/1959 | Caldwell et al. | 528/339 |
| 3,012,994 | 12/1961 | Bell et al. | 528/346 |
| 3,072,944 | 1/1963 | Clayton et al. | 15/167.1 |
| 3,112,301 | 11/1963 | Natta et al. | 526/351 |
| 3,143,527 | 8/1964 | Wittbecker | 528/341 |
| 3,188,673 | 6/1965 | Newman | 15/167.1 |
| 3,214,777 | 11/1965 | Kutik | 15/167.1 |
| 3,217,074 | 11/1965 | Gould et al. | 264/210.5 |
| 3,238,553 | 3/1966 | Bailey et al. | 15/207.2 |
| 3,263,258 | 8/1966 | Burge | 15/167.1 |
| 3,295,156 | 1/1967 | Brant | 15/167.1 |
| 3,302,230 | 2/1967 | Poppelman | 15/167.1 |
| 3,344,457 | 10/1967 | Grobert | 15/207.2 |
| 3,595,952 | 7/1971 | Boyer et al. | 264/235 |

(List continued on next page.)

FOREIGN PATENT DOCUMENTS

| | | | |
|---|---|---|---|
| 663 162 | 7/1995 | European Pat. Off. . | |
| 2.114.663 | 6/1972 | France . | |
| 2125920 | 9/1972 | France . | |
| 6-141929 | 5/1994 | Japan | 15/207.2 |
| 6-233709 | 8/1994 | Japan | 15/207.2 |
| 897404 | 5/1962 | United Kingdom . | |
| WO 95/33441 | 12/1995 | WIPO . | |
| WO 96/23431 | 8/1996 | WIPO . | |
| WO 96/39116 | 12/1996 | WIPO . | |

OTHER PUBLICATIONS

G. Natta in the "Journal of Polymer Science", vol. XVI, pp. 143 to 154 (1955).

*Primary Examiner*—Mark Spisich
*Attorney, Agent, or Firm*—Ernest V. Linek; Banner & Witcoff

[57] ABSTRACT

A toothbrush having an improved cleaning and abrasion efficiency, wherein the bristles are comprised of synthetic thermoplastic polymeric compositions, and contain longitudinal channels extending along the length thereof, having a depth sufficient to entrap a quantity of abrasive particles such that during brushing with a toothpaste, contact between the channel entrapped abrasive particles and the surfaces of the teeth is improved, resulting in a cleaning efficiency coefficient, CEC, above about 1.5 and, an abrasion efficiency coefficient, AEC, above about 1.5, while demonstrating suitable bristle wearability.

18 Claims, 5 Drawing Sheets

U.S. PATENT DOCUMENTS

| | | | |
|---|---|---|---|
| 3,613,143 | 10/1971 | Muhler et al. | 15/167.1 |
| 3,671,381 | 6/1972 | Hansen | 428/400 |
| 3,722,020 | 3/1973 | Hills | 15/167.1 |
| 3,745,061 | 7/1973 | Champaneria et al. | 428/398 |
| 3,906,090 | 9/1975 | Colodney | 424/52 |
| 3,911,102 | 10/1975 | Harrison | 424/49 |
| 3,927,200 | 12/1975 | Yoshimura et al. | 424/50 |
| 3,937,321 | 2/1976 | Delaney et al. | 206/524.5 |
| 3,939,520 | 2/1976 | Axelson | 15/167.1 |
| 4,036,949 | 7/1977 | Colodney | 424/49 |
| 4,160,022 | 7/1979 | Delaney et al. | 424/52 |
| 4,167,794 | 9/1979 | Pomeroy | 15/188 |
| 4,254,101 | 3/1981 | Denny, Jr. | 424/52 |
| 4,279,053 | 7/1981 | Payne et al. | 15/207.2 |
| 4,381,325 | 4/1983 | Masuda et al. | 428/91 |
| 4,441,227 | 4/1984 | d'Argembeau | 15/167.1 |
| 4,515,772 | 5/1985 | Parran, Jr. et al. | 424/57 |
| 4,547,362 | 10/1985 | Winston et al. | 424/49 |
| 4,594,242 | 6/1986 | Naganuma et al. | 424/57 |
| 4,684,518 | 8/1987 | Parran, Jr. et al. | 424/52 |
| 4,729,142 | 3/1988 | Yoshioka | 15/167.1 |
| 4,800,608 | 1/1989 | Key | 15/167.1 |
| 4,806,339 | 2/1989 | Parran, Jr. et al. | 424/52 |
| 4,806,340 | 2/1989 | Gaffar et al. | 424/52 |
| 4,806,348 | 2/1989 | Hartl et al. | 424/130.1 |
| 4,842,165 | 6/1989 | Van Coney | 222/95 |
| 4,852,202 | 8/1989 | Ledwitz | 15/167.1 |
| 4,863,722 | 9/1989 | Rosenthal | 424/49 |
| 4,885,155 | 12/1989 | Parran, Jr. et al. | 424/52 |
| 4,889,712 | 12/1989 | Gaffar et al. | 424/52 |
| 4,891,211 | 1/1990 | Winston | 424/52 |
| 4,898,193 | 2/1990 | Gueret | 132/218 |
| 4,925,654 | 5/1990 | Gaffar et al. | 424/52 |
| 4,927,281 | 5/1990 | Gueret | 401/129 |
| 4,943,429 | 7/1990 | Winston et al. | 424/52 |
| 4,950,479 | 8/1990 | Hill et al. | 424/49 |
| 4,958,402 | 9/1990 | Weihrauch | 15/207.2 |
| 4,993,440 | 2/1991 | Gueret | 132/218 |
| 4,999,184 | 3/1991 | Parran, Jr. et al. | 424/52 |
| 5,004,597 | 4/1991 | Majeti et al. | 424/52 |
| 5,020,551 | 6/1991 | Gueret | 132/200 |
| 5,032,387 | 7/1991 | Hill et al. | 424/49 |
| 5,128,208 | 7/1992 | Bond et al. | 428/397 |
| 5,180,576 | 1/1993 | Winston et al. | 424/52 |
| 5,195,546 | 3/1993 | Cansler et al. | 132/317 |
| 5,274,873 | 1/1994 | Shields | 15/167.1 |
| 5,335,389 | 8/1994 | Curtis et al. | 15/167.1 |
| 5,355,546 | 10/1994 | Scheier et al. | 15/167.2 |
| 5,360,025 | 11/1994 | Klinkhammer | 132/308 |
| 5,374,368 | 12/1994 | Hauschild | 510/304 |
| 5,396,678 | 3/1995 | Bredall et al. | 15/167.1 |
| 5,424,060 | 6/1995 | Hauschild | 424/52 |
| 5,497,526 | 3/1996 | Klinkhammer | 15/167.2 |
| 5,511,275 | 4/1996 | Volpenhein et al. | 15/167.1 |
| 5,701,629 | 12/1997 | O'Brien | 15/207.2 |

TOOTHBRUSH WITH IMPROVED CLEANING AND ABRASION EFFICIENCY

This application claims the benefit of U.S. Provisional Application Ser. No. 60/022,601 filing date Jul. 25, 1996.

FIELD OF THE INVENTION

A toothbrush having an improved cleaning and abrasion efficiency, wherein the bristles are comprised of synthetic thermoplastic polymeric compositions, and contain longitudinal channels extending along the length thereof, having a depth sufficient to entrap a quantity of abrasive particles such that during brushing with an abrasive toothpaste, contact between the channel entrapped abrasive particles and the surfaces of the teeth is improved, resulting in a cleaning efficiency coefficient, CEC, above about 1.5 and, an abrasion efficiency coefficient, AEC, above about 1.5 while demonstrating suitable bristle wearability.

BACKGROUND OF THE INVENTION

The present invention relates to a toothbrush having improved cleaning and abrasion efficiency while retaining acceptable wear characteristics.

In the oral hygiene field today, toothbrushing is ordinarily accomplished with a toothbrush which is adapted for use with a dentifrice composition, i.e., a toothpaste, which contains an abrasive substance or material designed to abrasively clean the teeth, i.e., to remove materials thereon, including pellicle, plaque, stains, dental calculus (tartar), and the like.

The current level of gum disease and tooth loss attributed to gum disease and gum retraction in adults, along with the incidence of gingivitis among adults, is an indication of the inefficiency of cleansing accomplished with those toothpaste/toothbrush combinations presently commercially available. In part, this poor cleaning is also due to the poor toothbrushing habits of a majority of adults which include; brushing only once a day, brushing improperly, and/or failing to brush long enough to effect adequate plaque, tartar removal, etc. Clearly, a more efficient toothbrush/toothpaste combination would be helpful.

In toothbrushing, the primary function of the bristle is to rub abrasive particles across the surface of the teeth and thereby remove by abrasive action deposits such as pellicle, stains, plaque, tartar and the like from tooth surfaces.

Accordingly, the tangential contact between toothpaste abrasive and surfaces of the teeth as influenced by toothbrush bristle tips during brushing has a major impact on toothbrushing efficiency.

Manufacturers of nylon bristle toothbrushes have provided in the past, a variety of toothbrushes designated as "soft," "medium," and/or "hard" to indicate the stiffness of the bristles. For a given thermoplastic polymeric composition, one factor, which predominantly determines bristle stiffness, is the diameter of the individual bristles. For example, with nylon 6,12 the "soft" bristles typically have a diameter between 0.008 and 0.009 inches; "medium" bristles have a diameter between 0.009 and 0.012 inches and "hard" bristles have a diameter greater than about 0.012 inches. Polybutylene terephtalate bristles are typically about 0.001 to 0.002 inches smaller in diameter due to the greater wet stiffness of this material over that of nylon 6,12. For all bristles used in toothbrushes, there is generally a manufacturing or grading tolerance of about ±0.0005 inches.

Soft bristles penetrate crevices between the teeth, while medium bristles and the hard bristles stabilize the soft bristles against bending as pressure is applied during brushing. The medium and hard bristles are believed to more effectively clean the surfaces of the teeth while the soft bristles achieve better penetration of crevices and are recommended for their gentleness to soft tissue.

Studies have shown that the most aggressive mechanical cleansing should be directed toward the tooth surface, with much less so toward the gingival surface and essentially none toward the base of the gingival sulcus. The basis for these observations is as follows:

1. The development of gingival inflammation and dental caries is most frequently caused by failure to remove dental plaque from the subgingival surface of the tooth and to a much lesser extent *materia alba* from the gingival surface in the subgingival space. Both dental plaque and *materia alba* can form within several hours of brushing and therefore frequent mechanical cleansing is essential. *Materia alba,* which consists primarily of an acquired bacterial coating and desquamated epithelial cells, leukocytes and a mixture of salivary proteins and lipids, is a soft sticky deposit less adherent than dental plaque. It can be flushed away with a water spray but more completely removed from the gingiva with mild mechanical cleansing.

2. Dental plaque is formed by oral microorganisms that synthesize harmful products that are destructive to the tooth and gums when not removed from the gingival sulcus. The toxins formed by these microorganisms cause cellular damage to the gingiva with subsequent inflammation (gingivitis) and eventually destruction of the supporting structures (periodontitis). When gingivitis occurs, vascular dilation, capillary proliferation, engorged vessels and sluggish venous return causes a stretched and thinned epithelium that is sensitive to mechanical trauma such as aggressive brushing.

3. Dental plaque with associated gingivitis also causes exposure of the root surface (recession) with increased occurrence of cavities (dental caries). Exposure of the root surfaces can also occur due to faulty brushing by repeated direct trauma to the base of the sulcus (gingival abrasion). When a pathologically deepened gingival sulcus (periodontal pocket) occurs, the pathological condition may become exacerbated because plaque can more readily occur. If dental plaque is not removed, calculus (tartar) is formed by mineralization of the bacterial plaque. Calculus can form within several hours of plaque formation. Calculus has a bacterial plaque coating and exacerbates gingivitis and gingival recession by both chemical irritation from the formed toxins and destruction from the mechanical irritation of the calculus mass. Subgingival calculus usually extends near but does not reach the base of periodontal pockets in chronic periodontal lesions. Calculus holds the plaque against the gingiva, and 4. Since *materia alba* can be removed by light mechanical cleansing and gingival inflammation causes thinning of the gingival epithelium the mechanical cleansing requirement of the gingival surface is much less than the requirement for removing dental plaque from the surface of the teeth.

Accordingly, a more efficient cleansing and abrading toothbrush, which fulfills the foregoing requirements while protecting the base of the gingival sulcus, is desirable.

Review of Prior Art

Toothbrush bristles have come a long way from the curly-tusked swine hair they were made from prior to World War II. First was the introduction of nylon synthetic fiber in 1938. The popular round toothbrush bristle style introduced in 1938 is used today in more than 50% of the premium toothbrushes used worldwide.

Since 1938 nearly all major toothbrush marketers have developed innovative "cosmetic" features which make their toothbrush offerings unique at the retail shelf These features included: colors, packaging, innovative handle and head designs, trimming alternatives, various tufting arrangements, various bristle lengths, bristle diameters, etc. Whatever the cosmetic feature(s) promoted, these commercial toothbrushes have typically relied on the basic cylindrical bristle with rounded tips for abrasive/tooth surface contact. See for example, U.S. Pat. Nos. 3,217,074, 4,898,193, 4,927,281, 4,993,440, 5,020,552 and 5,511,275.

Recently, unique bristle designs have been designed and commercialized reportedly to improve plaque removal, interdental cleaning, gum care and durability. All of these recent innovations also rely on the classic bristle tip (usually rounded) abrasive contact with the tooth surface to affect cleaning. See Tynex® *Shapes and Textures Toothbrush Filaments*" . . . because specialized cleaning starts at the tips" (H-50102) published by the DuPont Company, Washington WV 26181, 1995. This publication is hereby incorporated herein by reference.

Summarized below in Table 1 are some recent industry approaches to various consumer toothbrush needs where toothbrush bristle shape, and texture are varied to provide "specializing cleaning". Note: These approaches are based on bristle tip/toothpaste abrasive interaction to achieve cleansing and abrasion of tooth surfaces.

TABLE 1

| Consumer Need | Feature to Address Consumer Need | Recommended Tynex ® Bristle Construction |
|---|---|---|
| Interdental Cleaning | Fine tips able to reach farther between teeth. | Feathered |
| | More bristles per tuft working with every stroke. | Hexagonal |
| Plaque Removal | Higher surface contact area increased ability to hold toothpaste at tips. | Hexagonal |
| | | Feathered |
| | Higher functional abrasiveness. | Grainy, Co-Extruded |
| | Compliance with Bass brushing Methods. | Rectangular |
| Healthy Gums | Gentleness to the gums | Feathered, Rectangular |
| | End-rounded tips | All styles |
| | More surface area to distribute force applied to brush | Hexagonal |
| | Softness of tips | Feathered |
| Durability | Improved Wear Technology | All Styles |
| | Superior bristle integrity | Hexagonal |

Various cross-sectional geometric bristle shapes have been developed to enhance the performance of toothbrushes in general. For example, U.S. Pat. No. 2,317,485 teaches that circular cross-sectional bristles do not pack as efficiently as other shapes such as triangles, squares, pentagon's etc. U.S. Pat. No. 2,876,477 utilizes polygons with a concave contour on each side to maximize interstitial spacing. The corners of the bristle sides serve as scrapers for the bristles. The multi-fluted sides of these bristles are designed to function in a manner analogous to scaly natural bristles.

Bristle brushes other than toothbrushes with various cross-sectional shapes are disclosed in U.S. Pat. Nos. 4,386,325; 4,898,193; 4,167,794, 5,020,551 and 5,396,678. U.S. Pat. No. 5,396,678 teaches toothbrush bristles having a rectangular cross-sectional shape. U.S. Pat. No. 5,020,551 discloses various bristle cross sections including: solid circular, hollow circular, cruciform, and multilobal. U.S. Pat. No. 4,898,193 teaches multi-ridged polygon bristles for combing eyelashes and for applying mascara to the eyelashes. This reference teaches that the sides of the polygon bristle can curve inwardly. Similarly U.S. Pat. No. 4,381,325 discloses a liquid-retaining synthetic bristle having an acute ridgeline extending longitudinal on its surface. The bristle has at least one convex portion. The arcuate concave grooves were shown to retain more liquids such as India ink than non-ridged comparable brushes.

U.S. Pat. No. 3,613,143 discloses toothbrushes with abrasive impregnated bristles of two cross-section designs, i.e., generally circular and polygon with the latter described as having longitudinal groove arrangements.

U.S. Pat. No. 4,167,794 discloses rounded bristles having shovel-like distal ends for more effective plaque removal.

U.S. Pat. No. 4,958,402 teaches fiber-flocking synthetic bristles as a means of retaining the substance to be applied and more effectively distributing the substance on the surface to be treated. These fiber-coated bristles are taught for use in interdental cleaning. Similarly, U.S. Pat. No. 5,195,546 teaches having a gentle random and irregular wavy configuration along the length of the bristles for the improved application of powder to surfaces.

U.S. Pat. No. 2,312,828 teaches improved abrasive tooth surface contact by forming in the working face of the brush a longitudinal groove or channel of a size to receive and hold a strip of paste squeezed from the tube, this groove or channel being completely closed at its sides and ends by the outside longitudinal and transverse rows of full length bristles, so that the paste or powder deposits cannot fall from the brush.

U.S. Pat. No. 2,599,191 teaches improved toothbrushes for treating gum disease where the bristles are looped resulting in a smooth "side surface" contact with teeth and soft tissue.

U.S. Pat. No. 2,845,649 teaches a small diameter nylon bristle with higher tuft count produces a "sweeping action" as distinguished from traditionally "coarse" toothbrushes. It is suggested this sweeping action is gentler on soft tissue.

U.S. Pat. No. 4,993,440 describes a brush for the application of cosmetic products such as mascara, where the bristle has a capillary channel extending from the base to the tip. This channel has a V-shaped or U-shaped cross section designed to hold the mascara.

Toothbrush constructions of various types have been disclosed throughout the prior art to accommodate access to various components of an individual's mouth during a toothbrushing procedure. Such toothbrushes are exemplified in U.S. Pat. No. 4,800,608 wherein the bristle head is formed having a fixed obtuse angle. See also U.S. Pat. Nos. 3,072,944; 3,188,643; 3,263,258; 5,346,678; 5,274,873; 5,335,384; 5,355,546; 5,360,025; 5,497,526 and 5,511,275.

U.S. Pat. No. 4,729,142 sets forth a toothbrush head having the bristles directed towards the medial center of the toothbrush head.

U.S. Pat. No. 4,852,202 sets forth a toothbrush head having angulated bristles, wherein the bristles include first bristles having an orthogonal orientation relative to the toothbrush head, with a plurality of secondary bristles mounted at a generally forty-five degree angle relative to the toothbrush head.

U.S. Pat. No. 3,032,230 teaches bristles with a polygon cross-section having at least two acute angles that impart a "scraping" effect on the teeth. U.S. Pat. No. 3,214,777 teaches bristles with a rectangular cross-sectional area.

See also U.S. Pat. Nos. 2,088,839; 3,295,156; 3,722,020; 3,939,520; 4,167,794; 3,217,074; 3,238,553 and 4,927,281.

The prior art also teaches that generally, most adult toothbrushes have between 2000 and 3000 bristles with between 2300 and 2600 most popular. These bristles are usually arranged in three to five rows with about 15 tufts/row. In contrast, a child's toothbrush may have only three rows with approximately 10 tufts in each row.

Until the present invention, all toothbrush bristle constructions described in the prior art, including round, round/hollow, multi-lobal, rectangular, hexagonal, etc. type bristles could be characterized as effecting only tangential "point" contact between the bristle tip, the abrasive, and the surface. The present invention represents the next advance in this area, providing greater contact between these elements.

OBJECTIVES

The present invention thus has as its primary objective the enhancement of tooth cleaning and polishing through improved cleaning and/or abrasion efficiency wherein contact between cleaning abrasives and the toothbrushes of the present invention improve tooth surfaces. The improvement in cleaning efficiency is measured by a Cleaning Efficiency Coefficient, CEC, which is defined below. The improvement in abrasion efficiency is measured by an Abrasion Efficiency Coefficient, AEC, which is also defined below.

Another object of the present invention is to efficiently remove plaque and tartar and to provide a smooth tooth surface resistant to plaque and tartar buildup by enhancing the contact between abrasives and tooth surfaces with the improved toothbrushes of the present invention, wherein the abrasive is contained in a toothpaste also having a plaque buildup fighting, active ingredient that coats the freshly cleaned tooth surface with a poloxamer polydimethylsiloxane emulsion containing coating during the toothbrushing.

A further objective of the present invention is to enhance the cleaning of those tooth surfaces contiguous to the gingival margin and to interproximal surfaces by improving the contact between the abrasives in toothpaste and these various critical surfaces of the teeth by the toothbrush bristles of the present invention, whereby entrapped abrasive is delivered to these critical tooth surface areas during brushing in a manner sufficient to remove plaque, stains and tartar while depositing coating substances that help fight plaque and tartar buildup.

A still further object of the invention is to improve the tooth cleaning performance of the majority of toothbrushes who: (a) routinely fail to brush for a long enough period of time, i.e., 20 to 30 seconds vs. two minutes (as recommended by the American Dental Association, ADA); (b) fail to brush frequently, i.e., about once a day, vs. preferably after every meal and/or snack; and (c) brush with an improper brushing motion on most lingual and buccal surfaces vs. the recommended Bass Method of brushing.

Yet another object of the invention is to manufacture a toothbrush with improved cleaning efficiency coefficient, CEC, of at least about 1.5, along with an improved abrasion efficiency coefficient, AEC, of at least about 1.5 (as defined below).

Another object of the invention is to provide a means for efficiently cleaning and polishing hard oral surfaces while avoiding injuring the soft tissue.

A further object of the invention is to adapt the channeled, abrasive entrapping bristles, of the present invention to the various heads of commercial toothbrush innovations such as described in U.S. Pat. Nos. 3,072,944; 3,188,673;, 3,262,258; 5,274,873; 5,396,678; 5,335,389; 5,355,546; 5,360,025; 5,401,526; and 5,511,275.

Another object of the invention is to adapt the channeled, abrasive entrapping bristled toothbrushes of the present invention to the various commercial toothpastes, including those described in U.S. Pat. Nos. 4,254,101; 4,515,772; 4,999,184; 4,842,165; 4,684,518; 4,885,155; 4,806,339; 5,004,597; 4,806,340; 4,889,712; 4,925,654; 4,591,211; 5,374,368; 5,424,060 and 5,180,576.

Yet another object of the invention is to provide an improved method of caring for the teeth and gums using a toothpaste containing an active ingredient that fights plaque buildup.

SUMMARY OF THE INVENTION

The foregoing and other objects, advantages and features of the present invention are achieved through the use of toothbrushes with novel bristle construction, such as those illustrated in FIGS. 1–4. The present invention provides a more efficient toothbrush that has ribs and/or grooves on the bristle periphery. These ribs and grooves are sized and arranged as to trap and hold the toothpaste abrasives and other active ingredients against the teeth and soft tissue surfaces of the mouth more effectively than previously known brush designs.

In the preferred embodiments of this invention, the abrasive and/or tubule closing ingredients contained in various toothpastes are entrapped in longitudinal channels formed in the toothbrush bristles. During brushing these channel-entrapped-abrasives and tubule closing substances are brought into functional contact with tooth surfaces, resulting in improved cleaning efficiency and/or improved treatment of hypersensitivity. This is illustrated in FIGS. 6 and 7. The improved cleaning efficiency is measured by a Cleaning Efficiency Coefficient, CEC, as defined below, as is the improved Abrasion Efficiency Coefficient, AEC.

Specifically, the Cleaning Efficiency Coefficient (CEC) is a number which relates the cleaning efficiency of the novel toothbrush bristle construction to current standard round bristle construction, where both bristle types are tested in an identical head design and tuft placement. One advantage of such a Coefficient is the ability to compare complex variables, using multiple measures of cleaning. For example, such a coefficient is useful in comparing in vitro removal of artificial plaque, food debris, *materia alba,* etc. It is equally useful in correlating in vivo measurements on plaque and tartar removal or other clinical indications.

The CEC is a ratio of the efficiency of the test bristle to the efficiency of a standard round bristle under standardized use conditions. The ratio is expressed as the reduction in the parameter measured (plaque, for example) by the test bristle in any specific configuration, divided by the reduction in plaque produced by standard round bristles under identical toothbrush design and test conditions. See Example 1 and Table 4 below. This relationship may be expressed as follows:

$$CEC = \frac{Baseline_{Test} - Final_{Test}}{Baseline_{Std.Round} - Final_{Std.Round}}$$

"Cleaning Efficiency Coefficient" (or CEC), as noted above is an indicator of the cleaning improvement obtained with the toothbrushes of the present invention, as measured against a standard comprising a toothbrush with bristles of a circular cross-section, with both toothbrushes using the same abrasive containing toothpaste under standard brushing conditions. The CEC observed after crossover clinical testing, such as described in Example 1, and reported in FIG. 8 and in Table 4, is 2.5%. For purposes of the present invention, CEC values greater than about 1.5 are preferred. Particularly preferred are CEC values above about 2.0.

The unexpected improvement in cleaning efficiency as reported in Example 1 for the quadrachannel bristled toothbrush of the present invention, can also be expected for various other multi-channel bristle configurations such as those described in Tables 2 and 5 and illustrated in FIGS. 2–4 of the drawings. Improvements in AEC are also expected.

In addition to the above reported, yet unexpected and dramatic improvement in clinical cleaning efficiency observations, it has been further found that significant improvement in abrasive cleaning efficiency is achieved with the present invention, without incurring an observable adverse effect on the "soft tissue" contiguous to the teeth. In part this favorable tooth/soft tissue cleaning result is attributed to the "softer" bristles used in the toothbrushes of the present invention and to the efficient abrasive/tooth contact effected by the multi-channeled bristles of the present invention.

For the purposes of the present invention; the Abrasion Efficiency Coefficient (AEC) is defined as the ratio of the results of a standard RDA, Stain Index or Polishing Index procedure of a test bristle brush in a given tuft configuration to the results of an identical procedure using standard round bristles in the same tuft configuration. This relationship may be expressed as follows:

$$AEC_{RDA} = \frac{Baseline\ RDA_{Test} - Final\ RDA_{Test}}{Baseline\ RDA_{Std.Round} - Final\ RDA_{Std.Round}}$$

or $$AEC_{Stn\ Ind} = \frac{Baseline\ Stn\ Ind_{Test} - Final\ Stn\ Ind_{Test}}{Baseline\ Stn\ Ind_{Std.Round} - Final\ Stn\ Ind_{Std.Round}}$$

or $$AEC_{Polish\ Ind} = \frac{Baseline\ Polish\ Ind_{Test} - Final\ Polish\ Ind_{Test}}{Baseline\ Polish\ Ind_{Std.Round} - Final\ Polish\ Ind_{Std.Round}}$$

For the purposes of the present invention, AEC values for RDA, Stain Index and Polish Index above about 1.5 are preferred with values above about 2.0 being particularly preferred.

Relative Dental Abrasion (RDA) has long been the standard measurement for predicting the performance of a given toothpaste formulation, and/or the functionality of a series of abrasives having varying particle sizes, compositions of matter, crystal structures, fracture edges, etc. Typically a measured number of strokes with a standard toothbrush with a fixed applied pressure against a piece of dental enamel fixed in a holding plate is the basis of the test. Sometimes a plate of soft metal, such as copper, is substituted for the dental enamel as an inexpensive approximation method. The dental enamel is measured for loss of surface enamel (or metal) by a variety of methods, including weight loss, optical comparison and radioactive techniques.

A similar measurement using artificially stained enamel measures the abrasive removal of stain. In a similar fashion, one can evaluate the polishing of tooth surfaces, a process which increases the reflectance properties of the enamel without a high level of enamel removal or "scratching".

As long as the brush, its bristles, and the mechanical parameters are constant, the RDA (and its Stain Index and Polishing Index counterparts) has proven to be the most useful tool available to the toothpaste formulate. For the toothbrush designer using only round bristles of a given softness/hardness property, the RDA is of a lesser value in predicting in vivo performance, even if the abrasive formulation is kept constant, since bristle positioning has only modest impact on the abrasive properties of the chosen abrasive.

In the present invention, the changing of the bristle design according to the present specification impacts the abrasivity, both absolute and relative, of differing abrasives and formulations to a much greater extent. Therefore, to effectively appreciate and evaluate the advances of the present invention, it is necessary to modify the standard RDA and create a new measurement technique called the Abrasion Efficiency Coefficient (AEC).

It is self-evident that because the entrapment and resulting delivery of the abrasive agent to the tooth surface is more efficient as a result of this invention, certain abrasives (especially those with very high relative hardness or sharp crystal edges) will have a higher RDA when applied with these brushes.

Conversely, if a "non-scratching" abrasive is more effectively delivered, it can do a more complete job of removing plaque, or even polishing, without having to possess a high RDA. The advantage of this performance is obvious in that the teeth are more effectively cleaned, both clinically and cosmetically, without resort to the extent of enamel damage previously demonstrated with high RDA abrasive systems.

The longitudinal channel feature of the bristles of the present invention shown in FIGS. 1–4 requires a bristle core of sufficient diameter and strength to achieve:

a) strength/stiffness values and b) bend recovery/wear values such that the wearability of the toothbrushes of the present invention are comparable to commercially available toothbrushes with traditional bristle construction.

Were these strength/stiffness and bend recovery/wear values not factored into the channeled bristle designs of the present invention, the toothbrushes of the present invention would fall far short of conventional toothbrushes in the critical area of wearability.

The multi-channeled bristles of the present invention not only provide a substantial improvement in abrasive/tooth surface contact, attributed to entrapment of effective quantities of abrasive in the channels during brushing, but, in one embodiment of the invention, they also provide a unique interlocking bristle feature. That is, certain bristles of the present invention during brushing tend to interlock, resulting in less open space between bristles effecting a more contiguous contact with tooth surfaces, resulting in optimum CEC and AEC values. This interlocking of the channeled bristles of the present invention is best illustrated in FIGS. 5, 7 and 11(*a*) of the drawings.

Generally, the bristles of the present invention have sides more adaptable to interlocking and accordingly are readily distinguished from their round cross-section counterparts. As a result, toothbrushes of the present invention, with "interlocking" during brushing produce higher CEC and AEC values than other toothbrushes.

As described in greater detail below, the present invention is based upon the clinical observations that:

1. Best toothbrush action is accomplished by the "sides" of the bristles, rather than by the tips of the bristles. (see FIGS. 6 and 7)
2. Conventional bristles in combination with abrasive particles effect minimal "bristle driven abrasive cleaning action" during brushing.
3. During toothbrushing the bristles "flex" whereby the sides of the bristles rather than the tips become the "primary cleaning contact" area of the toothbrush with the surfaces of the teeth, (see FIGS. 6 and 7), and 4. Means for entrapping abrasive in the sides of toothbrush bristles will improve abrasive/tooth surface contact and cleaning efficiency of the toothbrush.

The current state of the art for toothbrush manufacturing emphasizes that: "superb end-rounding (of bristles) enhances gentleness to the gum line area" (see Tynex® reference, supra). The present invention suggests that channeled bristles entrapping abrasive producing improved CEC and AEC values assures gentleness to the gum line area, that can be clinically substantiated.

End-rounding the bristle tips of the present invention although doable, (See FIGS. 9 & 10) is not required for achieving comfort along the gum line and avoiding damage to the delicate gum tissue. That is, the overall softness of the bristles of the present invention in combination with the "flagging" achieved with the multi-channeled bristle tips of the present invention reduces the necessity of end-rounding these bristles. "Flagging" is discussed in detail below. The bristles of the present invention are generally perceived as softer and gentler on gums than most and rounded commercial bristles. The improved CEC and AEC performance of the brushes of the present invention reduces the brushing force required to achieve cleaning, thereby obviating damage to gum surfaces.

Toothbrushes of the present invention are particularly complementary of the dentist recommended Bass Method for brushing teeth. The Bass Method calls for up and down strokes on the sides of the teeth with back and forth strokes on the tops of teeth. The multi-channeled bristles of the present invention with their entrapped abrasive assure improved abrasive tooth surface contact with both "up and down" as well as "back and forth" strokes of the toothbrush. As a result, effective abrasion cleaning is achieved on the tops of the teeth while soft gentle thorough abrasion cleaning is effected on the sides of the teeth. This entrapped abrasive cleaning of the tops of the teeth and the sides of the teeth is schematically illustrated in FIGS. 6 and 7.

It is generally recognized in the art that non-round bristles (which would include the unique multi-channeled bristles of the present invention) provide substantially more softness than comparable round cross-section bristles when brushing the teeth with up and down strokes. (See Tynex® reference, supra). It is suggested that, this softness combined with the inherent gentleness on gums reported for the bristles of the present invention should help reduce gum retraction due to toothbrushing.

Historically, toothbrushing based gum retraction has been considered a major reason for tooth loss along with gum disease. The toothbrushes of the present invention with their "flagged" tips, and improved CEC and AEC values, promise to minimize toothbrushing based gum retraction, as detailed below.

The multi-channeled bristles of the present invention are particularly adaptable to splitting at the ends, i.e. "flagging", producing soft fine strands or "feathers" that have been reported to affect efficient interdental and gum cleaning while still being gentle on gums. These "feathers" at the tips of the bristles offer outstanding clinical benefits including:

(a) Higher contact surface area for the bristle tip which in combination with the channel entrapped abrasive affects unexpectedly improved cleaning efficiency, CEC;

(b) Superior plaque removal without damaging the gum: These soft multi-channeled bristles with feathered tips have the ability to reach further between teeth and gum line areas to enhance interdental and gum line cleaning; and (c) Superior cushion effect on the gums as perceived by subjects and generally described as "gentle on gums" during clinicals.

"Flagging" is described in U.S. Pat. Nos. 2,697,009, 2,911,761, 3,295,156, and 5,128,208, the disclosures of which are hereby incorporated herein by reference.

In a preferred embodiment of the invention, as illustrated in FIGS. 1 and 5–7, the toothbrush bristles contain longitudinal cavities such as channels extending along the length thereof having a depth sufficient to entrap abrasives having a particle size between about 3 and about 25 microns and preferably between about 6 and about 20 microns. FIGS. 2 and 3 illustrate various cross-sectional configurations of preferred abrasive entrapping bristles of the invention.

In another embodiment of the invention, the toothbrushes of the present invention are combined with toothpastes that also contain active ingredients that fight plaque buildup to provide an improved method of brushing teeth. This combination results in teeth with improved CEC and AEC scores that surprisingly also exhibit an improvement in fighting plaque buildup.

In a specific embodiment of the invention the combination of the toothbrushes of the present invention with certain toothpastes, in addition to providing improved cleaning and abrasion of the teeth, including improved plaque removal, unexpectedly produce a surprising reduction in plaque buildup. That is, when the toothbrushes of the present invention are used with toothpastes containing MICRODENT® ULTRAMULSION® an unexpected method of reducing plaque buildup is also obtained. Such toothpastes are disclosed in U.S. application Ser. No. 08/461,698, filed Jun. 5, 1995, now U.S. Pat. No. 5,733,529. Other preferred toothpaste compositions are disclosed in U.S. application Ser. No. 08/899,558, U.S. Pat. No. 5,993,784, filed on even date herewith. The contents of these two applications are hereby incorporated herein by reference.

It appears the improved cleaning and abrasion obtained by the channel-entrapped abrasives contacting the tooth surfaces provides optimum tooth surface preparation which is then followed up by a coating of tooth surfaces with MICRODENT® ULTRAMULSION®.

When a toothpaste containing MICRODENT® ULTRAMULSION® is used, those tooth surfaces that have been cleaned with the toothbrushes of the invention generally indicate a most thorough, consistent and effective coating that is well suited to resisting plaque buildup.

Specific preferred embodiments of abrasive entrapping bristles according to the present invention will now be described with reference to the accompanying drawings. In the description that follows, specific bristle constructions will be used for purposes of clarity, but these are not intended to define or to limit the scope of the invention, which is defined solely in the claims.

BRIEF DESCRIPTION OF THE DRAWINGS

In FIG. 1A the bristle channel is shaded in order to accentuate the abrasive entrapping feature to be described hereafter.

DETAILED DESCRIPTION OF THE PREFERRED EMBODIMENTS

For the purposes of the present invention, multi-sided channeled bristles are defined as toothbrush bristles that have been formed in a multi-channeled cross-section shape, wherein at least three, preferably four, most preferably five like-shaped individual channels are provided at the lower (i.e., tip) end of each bristle. The individual channels are thus capable of entrapping appreciable quantities of abrasive particles during brushing with a toothpaste, and the entrapped abrasive particles will be delivered to the surface of the teeth with a force sufficient to affect improved cleaning and abrasion efficiency, while avoiding abrasion of the enamel dentin and while avoiding adversely affecting the soft tissue.

For the purposes of the present invention, a "channel" is defined as a depression, hollow or cavity, which preferably extends the entire length of each bristle, wherein the cavity is of sufficient depth to accommodate sufficient toothpaste abrasive such that the entrapped abrasive is delivered to the tooth surface during brushing with a force from the channeled bristle sufficient to effect a Cleaning Efficiency Coefficient (CEC), of at least about 1.5, and an Abrasion Efficiency Coefficient (AEC), of at least about 1.5.

Figure 1A:
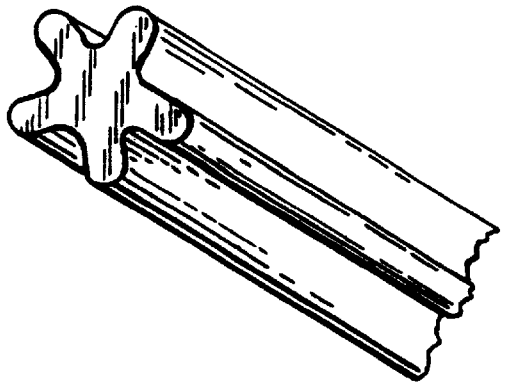
FIGS. 1A and 1B are schematic side views illustrating a 0.012 inch cross-section bristle embodying an abrasive entrapping channel of the invention, wherein the channel depth is about 0.003 and the channel breadth is about 0.006.
Figure 1B:
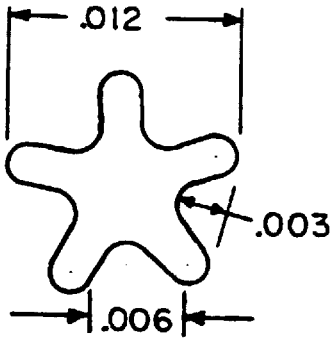

In one preferred bristle dimension of 0.012 inches in diameter as shown in FIG. 1, the preferred channel is about 0.013 inches deep with a breadth of about 0.006 inches. See also FIGS. 2–7 and 11(*a*) and Tables 2, 3 and 5. The dimensions of the channels are described in various Examples as set forth below. For example, at bristle diameters ranging from between about 0.008 and about 0.014 inches, channel depths from between about 0.007 and 0.005 inches are disclosed along with a channel breadth ranging from between about 0.003 and 0.006 inches. It is understood that for larger diameter bristles these channel depth and breadth values may increase substantially.

For the purposes of the present invention a toothbrush is defined as any manual, interproximal, or mechanical toothbrush containing multiple tufts of thermoplastic polymeric bristles, and specifically includes the various commercially available toothbrush handles and head designs popular today, as well as the various tuft arrangements, bristle variations, including various lengths of bristles and bristle bundle packs. These toothbrushes are marketed in the U.S. under trademarks including: Braun®, Interplak®, Oral-B®, Complete®, Precision®, Total®, REACH®, MentaDent®, IUM™, Gum®, InterPlak®, Oral Logic, etc. Various toothbrushes as described in the following U.S. patents are suitable for adaptation of the bristles of the present invention: U.S. Pat. Nos. 3,072,944, 3,188,673, 3,263,258, 5,396,678, 5,274,873, 5,335,389, 5,355,546, 5,360,025, 5,497,526, and 5,511,275. The teachings of these references are to be included in this specification by reference.

Figure 2A:
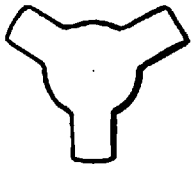
FIGS. 2A, B and C represent the present invention various tri-channeled cross-sectional bristle shapes applicable to the improved Cleaning Efficiency Coefficient (CEC) and Abrasion Efficiency Coefficient (AEC) toothbrush of the present invention.
Figure 2B:
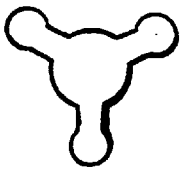
Figure 2C:
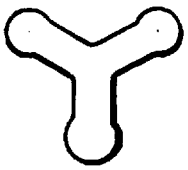
Figure 3A:
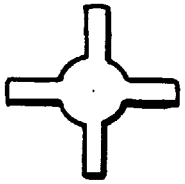
FIGS. 3A, B and C represents various quadra-channeled cross-sectional bristle shapes with various "channeling" suitable for the improved Cleaning Efficiency Coefficient (CEC) and Abrasion Efficiency Coefficient (AEC) toothbrush of the present invention.
Figure 3B:
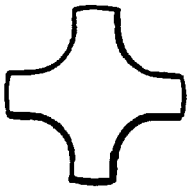
Figure 3C:
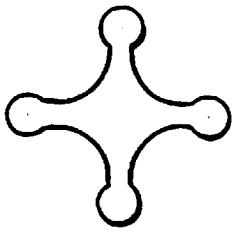
Figure 4A:
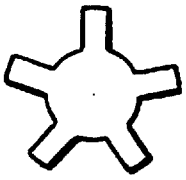
FIGS. 4A, B and C represent various poly-channel cross-sectional bristle shapes with various channeled bristles suitable for delivering the CEC and REC values of the present invention.
Figure 4B:
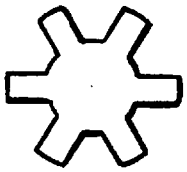
Figure 4C:
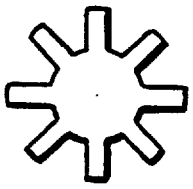
Figure 5:
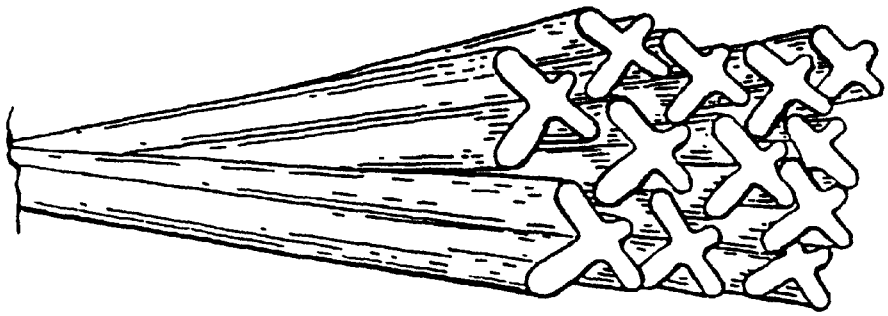
FIG. 5 is a perspective plan view of a toothbrush tuft of the present invention illustrating the tuft arrangement of one of the bristles of the present invention.

Suitable bristles of this invention having various cross-sectional shapes are illustrated in FIGS. 2 through 4 and discussed in detail in Tables 2–5 below.

Figure 6:
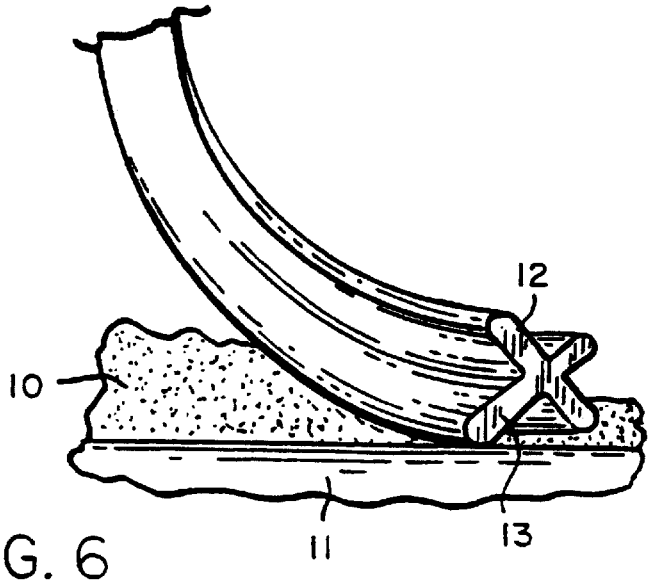
FIG. 6 illustrates schematically, the general contact between the channeled bristles of the present invention containing entrapped abrasive, and the tooth surface, during brushing.
Figure 7:
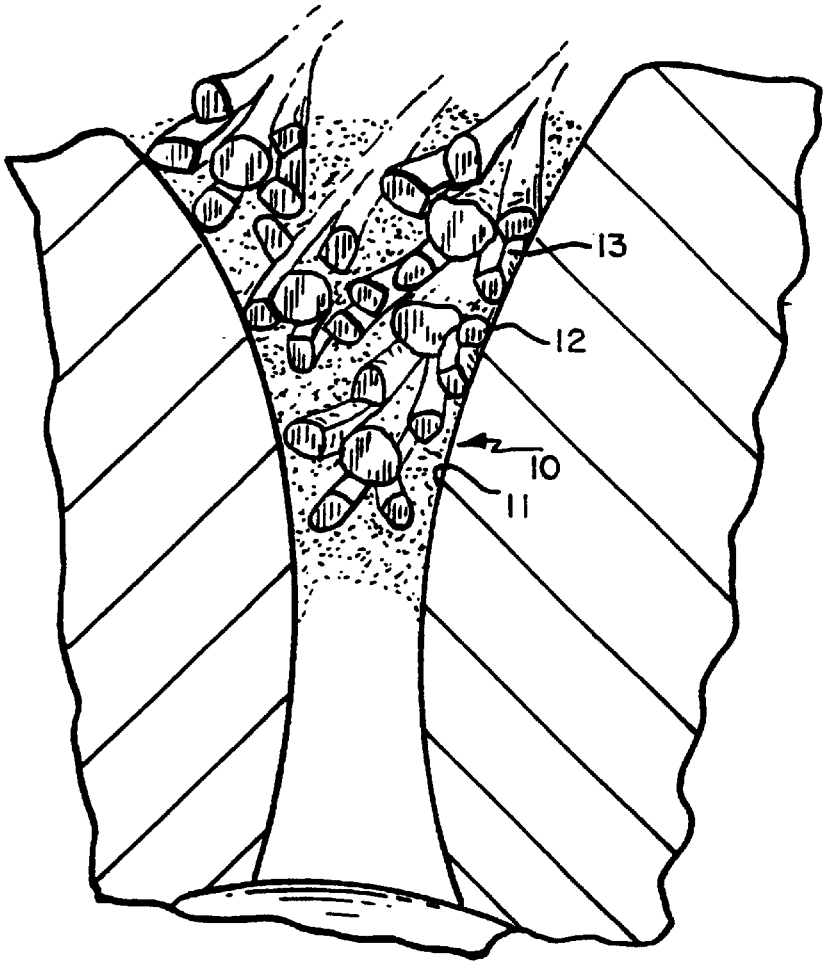
FIG. 7 illustrates schematically a magnified view of the contact between bristle-channel-entrapped abrasives and interproximal surfaces of the teeth during brushing with an abrasive containing toothpaste.

Referring now to FIGS. 6 and 7, the channel entrapped abrasive 10, is brought into contact with the various surfaces of the teeth 11 by bristle 12 in a wiping mechanism of action. In other words, upon flexing of bristle 12, bristle channel 13 achieves extended abrasive/tooth surface contact as illustrated at 6 and 7. In the wiping action, this surface contact is maintained between the bristle channel 13 and the tooth surface.

The polymers useful with the bristles of the present invention may be prepared by methods now well know in the art such as the procedures described by G. Notta in the *Journal of Polymer Science,* Vol. XVI. pp. 143 to 154 (1955) and in U.S. Pat. Nos. 2,882,263; 2,874,153; 2,913,442; 3,112,300 and 3,112,301 the disclosures of which are hereby incorporated herein by reference.

The bristles may be formed by melt extruding various thermoplastic polymeric materials through appropriately shaped extrusion orifices in various dies following various processes such as described in U.S. Pat. Nos. 2,226,529 and 2,418,482; 3,745,061; 3,238,553; 3,595,952; 4,279,053; French Patent No. 2,125,920, and European Patent Appln. No. 0663162171.

The tufting, cutting, stapling, etc., of the bristles is performed by processes known in the art; for instance as described in U.S. Pat. Nos. 4,441,227; 4,688,857; 979,782; 5,274,873; 5,335,389; and 5,511,275, the disclosures of which are hereby incorporated herein by reference.

For the purposes of the present invention, thermoplastic polymeric compositions suitable for the bristles of the present invention include synthetic linear condensation polyamides, such as described in U.S. Pat. Nos. 2,071,250, 2,071,251, 2,130,948 and 3,671,381.

The synthetic polyamides useful in the bristles of the present invention includes those which are of sufficient molecular weight to be fiber-forming such as: polycaprolactam, polyhexamethylene adipamide, polyhexamethylene sebacamide, the polyamide formed from 1,4,(cis)cyclohexane-bis(methylamine) and adipic acid (see U.S. Pat. No. 3,012,994); the polyamide from m-xylene diamine and adipic acid (see U.S. Pat. No. 2,916,475); the polyamide from 3,5 dimethyl hexamethylene diamine and terephthalic acid (see U.S. Pat. No. 2,752,358); the polyamide from 2,5 dimethyl piperazine and adipyl chloride (see U.S. Pat. No. 3,143,527). See also U.S. Pat. No. 2,152,606. The preferred polyamides are polyhexamethylene adipamide; and polyhexamethylene sebacamide.

In general, the number average molecular weight of the polymer used for these bristles should be in excess of 10,000 and preferably greater than 30,000 to provide the strength and stiffness needed in a toothbrush bristle. The commercial polyamides preferred include nylon 6,6; nylon 6,10 and nylon 6,12. Of these nylon 6,10 (polyhexamethylene sebacamide) and nylon 6,12 (hexamethylene diamine are particularly preferred. See Table 2.

Polyesters that have been found particularly well suited to the bristles of the present invention include polybutylene terphthalate and polyethylene terephtalate. (See Tables 3 and 5 below).

The overall diameter, or maximum cross-section for the bristles of the present invention can be between about 4 and 20 mils. Bristles outside this range, in general, will exhibit stiffness, which is unsuitable for toothbrush bristle applications of the invention. The bristles generally extend from between about 8 and 15 mm above the toothbrush head.

It is known that bristles of thermoplastic materials may have their properties enhanced by drawing or stretching the bristles to increase the molecular orientation along the fiber axis. Therefore, it is preferred to stretch orient the filaments used to make the bristles of the present invention or to apply other standards property-enhancing processing to the techniques thereto.

Examples of other thermoplastic polymeric compositions from which the bristles of this invention may be formed include: polyolefins such as polyethylene and polypropylene; polyacrylics such as polyalcrylonitrite, polyacrylamide, copolymers of acrylonitrile with methyl methacrylate, etc.; polyvinyl chloride and copolymers of vinyl chloride with other vinyl monomers, polymers of fluorinated olefins such as polytetrafluoroethylene; polystyrene; and the like.

Additionally, the uniquely channeled cross-sectional shapes of the bristles of the present invention can be co-extruded from two or more distinct thermoplastic polymeric materials.

For example, a polybutylene terephtalate core can be co-extruded with a multi-channeled sheath of 6,12 nylon to produce a multi-channeled bristle that has a smaller diameter core than an extruded polybutylene terephtalate multi-channeled bristle. Such co-extruded multi-channeled bristles combine the best properties of different thermoplastic polymeric materials to create co-extruded bristles with functional versatility including improved stiffness, softness, increased "packing", etc. Some of those are described in the Tynex® publication referenced above.

It is well known to those skilled in the art of toothbrush design and manufacture, that the bristle and its resulting "tuft" must possess certain optimum characteristics commonly described, for example, as (a) softness, (b) flex strength, (c) recovery, (d) wet strength, (e) bendability, (f) permanent deformation, and others.

Typically, this requires balancing parameters such as (a) polymer type, (1,) diameter of bristle (c) end rounding, (d) flagging, (e) extent of orientation during bristle drawdown, (f) bristle length, and others.

It will be equally clear to those skilled in the art that similar commercial optimization is required for each of the novel bristle of this invention. In addition to the parameters balanced when studying round bristle construction, one must additionally consider such parameters as, for example, (a) the dimensions of the "core" around which the channels are arranged, (b) the dimensions of the sides of the channels and (c) the internal dimensions of the channel itself Generally, it is preferred that the channel depth is approximately 10 to 30% of the bristle diameter, as measured at the maximum cross-section, where the channel breadth can vary from between about 10 to about 60% of the bristle diameter. In a particularly preferred embodiment of this invention, a penta-channel bristle having a maximum cross-section diameter of about 0.012 inches, has five channels with an average depth of about 0.003 inches and an average channel breadth at the center of the channel of about 0.006 inches. See FIG. 1 of the drawings.

The currently preferred embodiment of the bristle design of the present invention is a five-sided star shape bristle. While the five-sided star shape has been selected as the first commercial embodiment, due to its mouth-feel, clinical results, and ability to withstand deformation or "wear-out" during a simulated one-to-three month wear test, it is anticipated that other star shapes will also prove to be commercially viable. Accordingly, it is anticipated that other bristle designs, e.g., 4, 5, 6, etc. sided stars (or other shapes) having dimensions which vary from that of the currently preferred embodiment will also prove useful in this invention.

One practical side-effect of providing the multi-channel bristles of this invention is that industry standards determined by experience over the years for round bristle parameters may need to be altered for channeled bristles. Thus, each channeled bristle should be optimized in its own right. For example, a round bristle made of 6,12 nylon with a 0.008" diameter will exhibit certain desired commercial properties described as a "soft toothbrush, where as a channeled bristle may require a larger total diameter and careful attention to the "core" dimension or even a different polymer in order to achieve the same properties. This is illustrated in Table 2 below.

TABLE 2

| | Bristle Properties | | | | | | |
|---|---|---|---|---|---|---|---|
| RESIN TYPE | NYLON 6,12 | NYLON 6,12 | NYLON 6,12 | NYLON 6,6 | NYLON 6,6 | NYLON6 | NYLON6 |
| Bristle Shape | Trichannel | X-shaped | Quadrachannel | Pentachannel | Hexachannel | Cruciform | Octafoliate |
| Size (inch) | .006–.040 | .008–.020 | 0025–.005 | .006–.043 | .005 | .006–.040 | .005 |
| Specific gravity ($g/cm^3$) | 1.04–1.05 | 1.04–1.05 | 1.13–1.14 | 1.13–1.13 | 1.13–1.14 | 1.13–1.14 | 1.13–1.14 |
| Tensile Strength (psi) in m | 50–60 | 50–60 | 50–60 | 60–70 | 60–70 | 50–60 | 50–60 |

TABLE 2-continued

| Bristle Properties | | | | | | | |
|---|---|---|---|---|---|---|---|
| RESIN TYPE | NYLON 6,12 | NYLON 6,12 | NYLON 6,12 | NYLON 6,6 | NYLON 6,6 | NYLON6 | NYLON6 |
| Tensile elongative (%) | 45–65 | 45–65 | 45–65 | 35–50 | 35–50 | 35–50 | 35–50 |
| Melting Point ° F | 403–419 | 403–419 | 403–419 | 500 | 500 | 410–436 | 410–436 |
| Dry Stiffness Modulus (psi) in m | 450 | 450 | 450 | 500 | 500 | 450 | 450 |
| Wet Stiffness Modulus (psi) in m | 415 | 425 | 425 | 180 | 180 | 65 | 65 |

Polybutylene terephtalate bristles illustrative of the toothbrushes of the present invention are described in Table 3 below.

TABLE 3

| Thermoplastic Polybutylene terephtalate Bristles | | | | |
|---|---|---|---|---|
| Bristle Shape | Trichannel | Tetrachannel (X) | Pentachannel | Hexachannel |
| Diameter (inch) | 0.010 | 0.008 | 0.007 | 0.014 |
| Channel Depth (inch) | 0.003 | 0.0025 | 0.0025 | 0.002 |
| Channel Breadth (inch) | 0.006 | 0.0045 | 0.0040 | 0.003 |
| Sp. Gravity (g/cc) | 1.32 | 1.32 | 1.32 | 1.32 |
| Tensile Strength (psi) | 40–50 | 40–50 | 40–50 | 40–50 |
| Tensile Elongation (%) | 35–55 | 35–55 | 35–55 | 35–55 |
| Melt Point (° F) | 435 | 435 | 435 | 435 |
| Dry Stiffness Modulus (psi) | 320–365 | 320–365 | 320–365 | 320–365 |
| Wet Stiffness Modulus (psi) | 300–340 | 300–340 | 300–340 | 300–340 |

For the purposes of the present invention, abrasive is defined as traditional toothpaste abrasives as discussed in detail below, wherein the particle size (mean diameter) is between about 3 and about 25 microns.

Particularly preferred are abrasive mixtures where the secondary abrasive is the type used in translucent dentifrice gels at levels up to about 20%. Some of these mixtures are described in the following U.S. Pat. Nos. 3,927,200; 3,906,090; 3,937,321; 3,911,102; 4,036,949; 4,891,211; 4,547,362; 5,374,368; 5,424,060; 5,180,576; 4,943,429; 4,160,022. Some of these mixed abrasives are commercially available, e.g., Sylodent 15, Sylodent 2 (W.R. Grace), Aerosil 200 (Degussa) and Cabosil (Cabot).

The size of the abrasive particles are most commonly expressed in "mean diameter" i.e., the arithmetical average of the diameters of particles in a representative sample. The mean diameter value of abrasive particles is usually described in microns. Abrasives having particle sizes between about 3 and 25 microns and preferably between about 6 and about 20 microns are particularly preferred for the channel designs of the toothbrush bristles of the present invention.

The preparation of suitable particle size abrasives can be accomplished by conventional techniques well known to the art. Basically, these techniques involve milling various abrasive materials, followed by standard screen sieving (or air separation) to segregate the desired particle size range.

Preferred plaque and tartar fighting active ingredients that help control plaque and tartar buildup when included in a toothpaste are the surfactant/polydimethyl-siloxane hot melt emulsions commercially available under the trademark MICRODENT®. These are described in U.S. Pat. Nos. 4,950,479 and 5,032,387. Particularly preferred plaque and tartar fighting active ingredients are surfactant/polydimethyl-siloxane emulsions where the polydimethyl-siloxanes are high molecular weight substances. Such surfactant -polydimethyl-siloxane emulsions are described in pending U.S. patent application Ser. No. 08/144,778 U.S. Pat. No. 5,538,667 and related applications. These are available commercially under the trademark ULTRAMULSION®. See Examples 6–9 below for improved methods of fighting tartar, plaque and stains utilizing the toothbrush of the present invention with certain toothpastes that capitalize on the clean tooth surfaces obtained with the toothbrushes of the present invention.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

Figure 9:
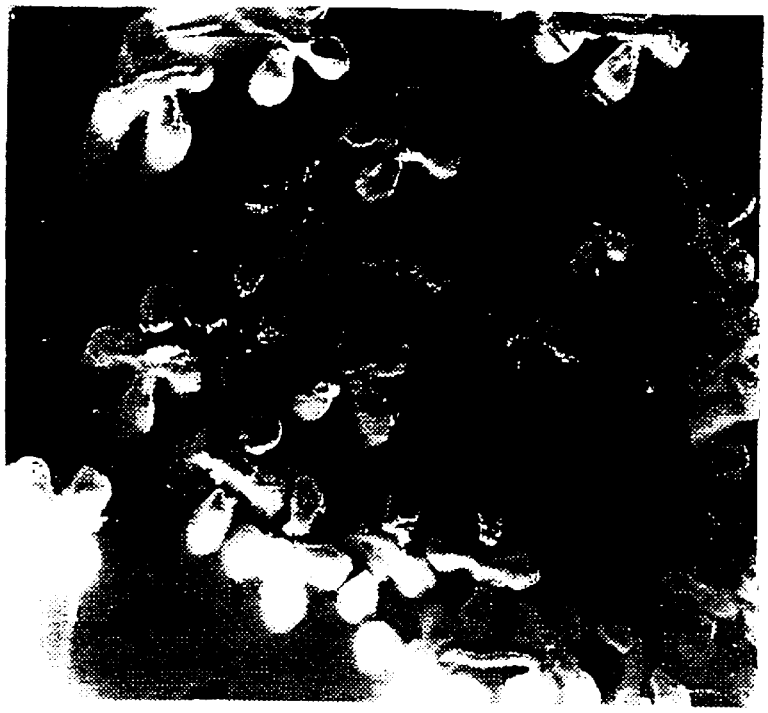
FIGS. 9 and 10 are electron microphotographs of tips of toothbrush bristles of the present invention, and a conventional round toothbrush bristle tips.
Figure 10:
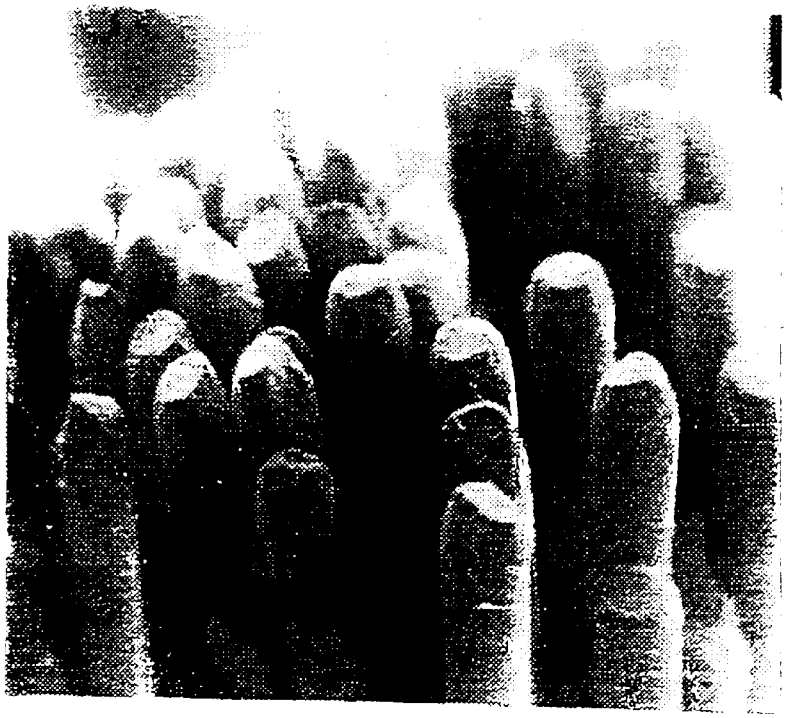
Figure 11A:
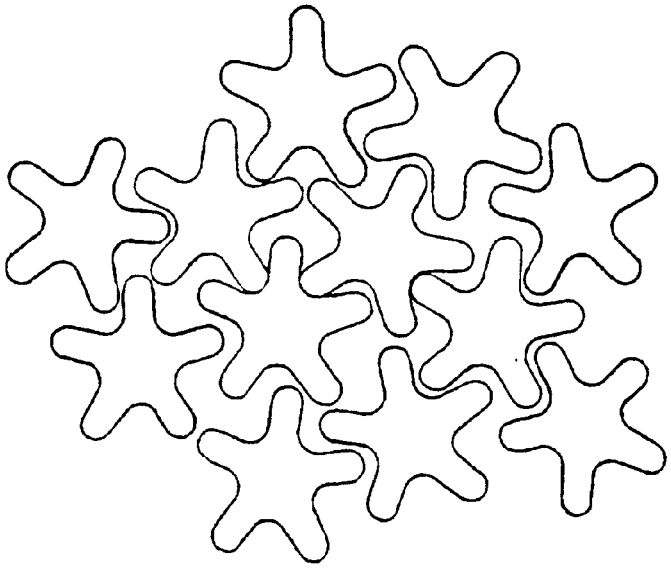
FIG. 11(*a*) illustrates schematically a magnified view of a cross-section of the "packing" of one of the bristles of the invention into a tuft with the bristle interlocking feature of the present invention (11A) compared to the cross-section packing of rounded bristles into a tuft FIG. 11(*b*).
Figure 11B:
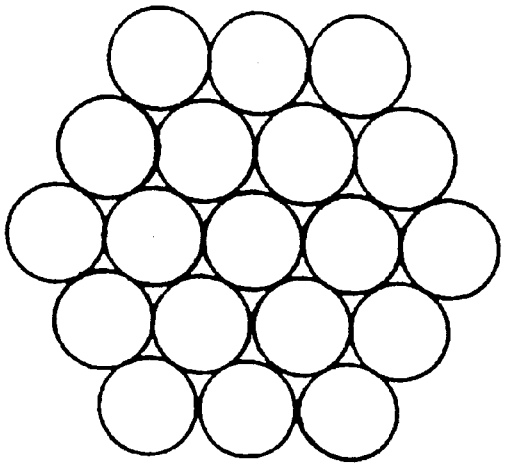

In a crossover clinical toothbrushing study, patients brushed with a quadrachannel bristle toothbrush and/or a contour rounded bristle toothbrush and then switched to the other toothbrush. The ends of the bristles in these brushes are shown electron micrographs in FIGS. 9 and 10. Plaque scores were established before and after brushing with each brush.

Figure 8:
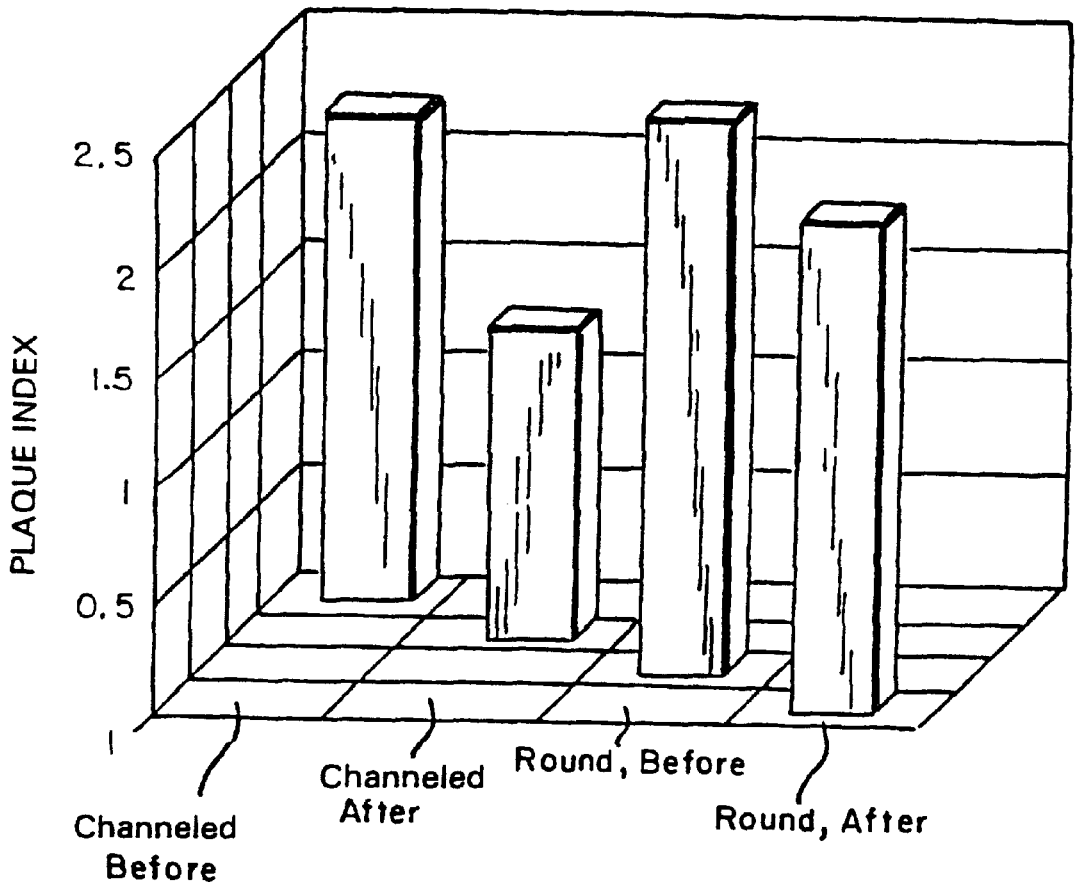
FIG. 8 is a bar chart that compares the average plaque scores for a quadra-channeled bristle toothbrush of the present invention compared to a toothbrush with round bristle configuration when both are used in a crossover clinical study, with a common commercial toothpaste, as described in detail in Example 1.

The results are reported in Table 4 below and in FIG. 8. The CEC values for this quadrachannel bristled brush were substantially greater than 1.5, i.e., about 2.59. This was a statistically significant value with (p=0.001), even with the small number of subjects per cell.

TABLE 4

| Data Summary of the Crossover Clinical Study | | | | | | |
|---|---|---|---|---|---|---|
| | Quadrachannel | | | Round | | |
| Subject | Before | After | Difference | Before | After | Difference |
| 02 | 2.20 | 0.82 | 1.38 | 2.29 | 1.88 | 0.41 |
| 03 | 1.85 | 0.63 | 1.22 | 2.26 | 1.62 | 0.64 |
| 04 | 1.58 | 0.57 | 1.01 | 1.96 | 1.40 | 0.56 |
| 06 | 1.60 | 0.55 | 1.05 | 1.83 | 1.36 | 0.47 |
| 07 | 2.30 | 1.73 | 0.57 | 2.30 | 1.97 | 0.33 |
| 09 | 2.06 | 1.26 | 0.80 | 1.94 | 1.82 | 0.12 |
| 10 | 2.03 | 0.99 | 1.04 | 1.79 | 1.78 | 0.01 |
| 11 | 2.19 | 1.20 | 0.99 | 2.27 | 1.84 | 0.43 |
| 12 | 2.49 | 1.16 | 1.33 | 1.79 | 1.78 | 0.01 |
| 13 | 2.09 | 1.48 | 0.61 | 2.37 | 2.05 | 0.32 |
| 14 | 3.67 | 2.00 | 1.67 | 3.38 | 2.21 | 1.17 |
| Average | 2.19 | 1.13 | 1.06 | 2.20 | 1.79 | 0.41 |
| Std. Dev. | 0.56 | 0.48 | 0.33 | 0.45 | 0.26 | 0.33 |
| Min. | 1.58 | 0.55 | 0.57 | 1.79 | 1.36 | 0.01 |
| Max. | 3.67 | 2.00 | 1.67 | 3.38 | 2.21 | 1.17 |

EXAMPLES 2 THROUGH 5

Examples 2 through 5 below are illustrative of various unique toothbrush/toothpaste embodiments of the present invention. These Examples are shown in Table 5 below.

TABLE 5

| Example No. | 2 | 3 | 4 | 5 |
|---|---|---|---|---|
| Bristle Thermo-plastic Polymeric Material | Polybutylene terephtalate | Poly-propylene | Polybutylene terephtalate | Polyacrylo-nitrate |
| Bristle Shape | Hexa-channeled | X-shaped | Cruciform | Penta-channel |
| No. of Bristles/Tuft and No. of Tufts in Toothbrush Head | 6/20 | 8/30 | 4/15 | 10/24 |
| Particle size of toothpaste abrasive in microns | 3–6 | 6–20 | 3–25 | 6–18 |
| CEC in % | 10 | 65 | 30 | 70 |
| Antiplaque/ Anti-tartar | MICRO-DENT ® | MICRO-DENT ® | ULTRA-MUL-SION ® | ULTRA-MUL-SION ® |
| Active ingredient/ and mol. wt. of polydi-methyl-siloxane | 12,000 | 1500 | 2.5 million cs | 50 million cs |

EXAMPLES 6–9

Using standard toothpaste formulating procedures such as those taught in U.S. Pat. No. 4,254,101, the ULTRAMULSION® containing toothpastes identified below in Table 6 were prepared. All percentages reported below are percent by weight. PDMS is an abbreviation for polydimethylsiloxane.

TABLE 6

| | ULTRAMULSION ® Toothpaste | | | |
|---|---|---|---|---|
| Example No. | 6 | 7 | 8 | 9 |
| Ingredients (wt. %): | | | | |
| Deionized Water | 16.87 | 30.44 | 43.76 | 16.87 |
| Sorbitol-70% Aq. | 18 | 24.6 | 20 | 18 |
| Glycerin | 10 | 8 | 10 | 10 |
| Dicalcium Phosphate | 49 | x | x | 49 |
| Aluminum Oxide | x | 10 | x | x |
| Hydrated Silica | x | 20 | 19 | x |
| Cellulose Gum | 1 | 0.8 | x | 1 |
| Xanthan Gum | x | x | 0.9 | x |
| Sodium Monofluoro Phosphate | 0.76 | 0.76 | 0.76 | 0.76 |
| Titanium Dioxide | 0.5 | 0.4 | 0.6 | 0.5 |
| Sodium Saccharin | 0.27 | 0.2 | 0.28 | 0.27 |
| PEG-8 | x | 1 | 0.8 | x |
| Flavor | 0.8 | 1 | 0.9 | 0.8 |
| Sodium Lauryl Sulfate | 0.8 | 0.8 | 1 | 0.8 |
| ULTRAMULSION (2,500,000 cs PDMS) | 2 | x | x | x |
| ULTRAMULSION (50,000,000 cs PMDS) | x | 2 | x | x |
| ULTRAMULSION (12,500 cs PMDS) | x | x | 2 | x |
| ULTRAMULSION (1,500 cs PMDS) | x | x | x | 2 |
| TOTAL | 100 | 100 | 100 | 100 |

EXAMPLE 10

Comparison of Penta-Channeled Bristles of Varying Channel Depth With Round Bristles (polybutylene terphthalate)

Clinical Protocol:

Nineteen subjects, screened for good oral health were instructed to refrain from brushing for 24 hours. The plaque of each subject was stained and scored for Plaque utilizing a standard method (Turesky modification of Quigley-Hein). The subjects then took their assigned brush and assigned toothpaste (ColgateΛ Fluoride Toothpaste) and brushed without benefit of a mirror for one minute, after which they were re-stained and residual plaque was re-scored using the same Index. Each of the nineteen used each brush in trials one week apart so the subjects were their own control. Between trials the subjects returned to their normal oral hygiene habits, assuring a constant return to baseline.

All toothbrushes tested were identical in shape, number and placement of bristles and by the naked eye, appeared to be completely identical. Only microscopic examination of the bristles for the presence of channels could disclose a difference. The toothbrush shape selected for this trial was the very popular "diamond head" shape commercially available as Colgate PlusΛ and numerous private label brands.

Results:

As shown in Table 7 below, there is a dramatic difference in plaque removal comparing the channeled bristle to the round bristle. There is likewise a distinct correlation between channel depth and relative plaque removal. These differences are statistically significant ($p \leqq 0.0001$) after a single brushing. Although both penta-channeled bristle designs were effective, these data suggest that the deeper the channel, the greater the effectiveness on cleaning.

TABLE 7

Comparison of Pentachannel Bristles of Varying Depth With Round Bristles (polybutylene terphthalate)

| | ROUND | PENTA-CHANNEL (1) | PENTA-CHANNEL (2) |
|---|---|---|---|
| Outside diameter (inch) | 0.007 | 0.007 | 0.007 |
| CHANNEL DEPTH (inch) | -0- | 0.0012 | 0.0009 |

PLAQUE INDICES (Std. Dev.)

| INDEX | Before Brushing | After Brushing | Before Brushing | After Brushing | Before Brushing | After Brushing |
|---|---|---|---|---|---|---|
| Whole Mouth | 2.28 (0.27) | 1.81 (0.27) | 2.21 (0.5) | 1.04 (0.44) | 2.23 (0.31) | 0.83 (0.36) |
| Proximal Surfaces | 2.40 (0.24) | 1.99 (0.28) | 2.38 (0.11) | 1.13 (0.12) | 2.34 (0.28) | 0.88 (0.39) |
| Posterior Surfaces | 2.43 (0.23) | 1.94 (1.94) | 2.29 (0.41) | 1.14 (0.47) | 2.38 (0.29) | 0.92 (0.37) |
| Smooth Surfaces | 2.04 (0.32) | 1.45 (0.27) | 1.87 (0.57) | 0.88 (0.35) | 2.03 (0.37) | 0.74 (0.30) |

(1) There was no statistical differences between the "Before Brushing" means for any bristle shape using any of the reported Indices. (ANOVA)
(2) Underlined means are statistically significant ($p < 0.0001$) from their ROUND "After Brushing" cohort. (paired t-test)

EXAMPLE 11

Comparison of Round Bristles of Two Polymer Types With Pentachanneled Bristles

This protocol was identical to the previous Example except that there were five (5) subjects using the round nylon bristle and the pentachannel PBT bristle in this trial. The toothbrushes were also of the same construction as in Example 10 and not discernibly different to the naked eye.

The results comparing a nylon round bristle, a PBT round bristle and a PBT pentachannel bristle are set out in Table 8 below. The column of data for the round PBT bristle is the same as in the previous Example. In spite of the disparity in the number of subjects tested, the statistical significance remained and this experiment clearly indicates that it is the presence of the channels which contributes to the greater removal of plaque in a single brushing, whereas the polymer selected for manufacturing the bristle did not produce a comparable effect on the plaque removing properties.

However, standard wear tests of various bristles suggest that channeled bristle toothbrushes constructed of polybutylene terephtalate are preferred over comparably channeled bristle toothbrushes constructed of nylon (TYNEX®).

TABLE 8

Comparison of Two Round Bristle Types with One Pentachannel Bristle Type

| | NYLON (TYNEX ®) ROUND | PBT* ROUND | PBT* PENTA-CHANNEL |
|---|---|---|---|
| Outside diameter (in) | 0.007 | 0.007 | 0.007 |
| CHANNEL DEPTH(in) | -0- | -0- | 0.001 |

WHOLE MOUTH PLAQUE INDEX** (Std. Dev.)

| Before Brushing | After Brushing | Before Brushing | After Brushing | Before Brushing | After Brushing |
|---|---|---|---|---|---|
| 2.14 (0.10) | 1.79 (0.06) | 2.28 (0.27) | 1.81 (0.27) | 2.17 (0.13) | 0.95 (0.18) |

Footnotes:
1. *PBT = polybutylene terephtalate.
2. **PLAQUE INDEX = Turesky modification of Quigley Hein.
3. Underlined mean was statistically significant ($p < 0.0006$) difference when compared to either "After Brushing" with round bristles. (unpaired t-test)
4. There was no statistical significance between any "Before Brushing" means. (ANOVA)

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A toothbrush having improved cleaning efficiency, said brush consisting of an elongated handle member and a head member, said head member having a plurality of bristles projecting from one side thereof, said bristles having a length of from about 8 to 15 mm and a maximum cross-section diameter ranging from about 4 to 20 mils, said bristles comprising a synthetic thermoplastic polymeric composition, wherein lateral surfaces of said bristles contain at least two longitudinal channels extending along the length of said bristles, wherein the channels have a depth ranging from about 10 to 30 percent of the bristle diameter as measured at the maximum cross-section, and wherein the breadth of the channels is from about 10 to 60 percent of the bristle diameter as measured at the maximum cross-section.

2. A toothbrush according to claim 1, wherein the lateral surfaces of said bristles comprise from between about 3 and 8 channels extending substantially the length of the bristles.

3. A toothbrush according to claim 2, wherein said bristles have cross-sectional configurations selected from the group consisting of trichannel, quadrachannel, pentachannel, hexachannel and heptachannel configurations, and combinations thereof.

4. A toothbrush according to claim 1, wherein the cross-sectional configuration of said bristles comprises three or more channels, shaped to readily accept a quantity of abrasive having an average particle size between about 6 and about 20 microns.

5. A toothbrush according to claim 1, wherein each of the bristles have the following physical characteristics: a diameter between about 0.008 and 0.014 inches, a channel depth between about 0.002 and 0.005 inches and a channel breadth between about 0.003 and 0.006 inches.

6. A toothbrush according to claims 1, wherein the bristles interlock during brushing.

7. A toothbrush according to claim 1, having a cleaning efficiency coefficient of at least about 2.0 and an abrasion efficiency coefficient of at least about 2.0.

8. A toothbrush according to claim 1, wherein the bristle tips are flagged.

9. A toothbrush according to claim 1, wherein the bristles are formed by melt extruding a synthetic thermoplastic polymeric composition selected from the group consisting of synthetic linear condensation polyamides, polyolefins, polyacrylics, polyacrylamides, copolymers of acetonitrile with methyl methacrylate, polyvinyl chloride, copolymers of vinyl chloride with other vinyl monomers, polymers of fluorinated olefins and polystyrene.

10. A toothbrush according to claim 9, wherein the bristles are formed by melt extruding nylon.

11. A toothbrush according to claim 9, wherein the bristles are formed by melt extruding polybutylene terephtalate.

12. A toothbrush according to claim 9, wherein the synthetic polyamide is Nylon 6,12.

13. A toothbrush according to claim 9, wherein the synthetic polyamide is Nylon 6,6.

14. A toothbrush according to claim 9, wherein the synthetic polyamide is Nylon 6.

15. A toothbrush according to claim 1, wherein the abrasion efficiency coefficient values for at least one of RDA, Stain Index and Polishing Index are above about 1.5.

16. A toothbrush having improved cleaning efficiency, said brush consisting of an elongated handle member and a head member, said head member having a plurality of bristles projecting from one side thereof, having a length of from about 8 to 15 mm and a maximum cross-section diameter ranging from about 4 to 20 mils, wherein lateral surfaces of said bristles contain at least one longitudinal channel extending along the length of said bristles, wherein each channel has a depth ranging from about 10 to 30 percent of the bristle diameter as measured at the maximum cross-section, and wherein the breadth of the channel is from about 10 to 60 percent of the bristle diameter as measured at the maximum cross-section.

17. A toothbrush according to claim 16, wherein the lateral surfaces of said bristles comprise a multiplicity of channels extending the entire length of the bristles.

18. A toothbrush according to claim 17, wherein said bristle channels are selected from cross-sectional configurations selected from the group consisting of trichannel, quadrachannel, pentachannel, hexachannel and heptachannel configurations, and combinations thereof.

* * * * *